United States Patent [19]

Denning et al.

[11] 4,297,393

[45] Oct. 27, 1981

[54] METHOD OF APPLYING THIN METAL DEPOSITS TO A SUBSTRATE

[75] Inventors: Richard Denning, Springfield; Mark A. Spak, Edison; Barry Polhemus, Hampton, all of N.J.

[73] Assignee: RCA Corporation, New York, N.Y.

[21] Appl. No.: 125,639

[22] Filed: Feb. 28, 1980

[51] Int. Cl.³ ..... C23C 3/02; H01L 21/288

[52] U.S. Cl. ..... 427/88; 427/92; 427/93; 427/304; 427/305; 427/383.3

[58] Field of Search ..... 427/92, 93, 304, 305, 427/88, 383.3

[56] References Cited

U.S. PATENT DOCUMENTS

| | | | |
|---|---|---|---|
| 3,630,767 | 12/1971 | Linstedt et al. | 427/92 |
| 3,632,436 | 1/1972 | Denning | 427/92 |
| 3,856,565 | 12/1974 | Arnold | 427/304 |
| 3,949,120 | 4/1976 | Leibfried | 427/92 |
| 3,963,523 | 6/1976 | Tanaka et al. | 427/88 |
| 4,039,698 | 8/1977 | Fraser et al. | 427/125 |
| 4,228,201 | 10/1980 | Feldstein | 427/305 |

*Primary Examiner*—John D. Smith

*Attorney, Agent, or Firm*—B. E. Morris; H. F. VanDenburgh

[57] ABSTRACT

A method of applying thin metal sensitizing deposits to the exposed silicon areas of a silicon substrate having areas of exposed silicon and silicon oxide, including the steps of immersing the silicon substrate in a basic, aqueous solution containing a metal salt of the metal to be deposited, particularly a nickel, cobalt, or platinum salt, and thereafter reducing the metal ion of the salt to the elemental metal by use of the exposed silicon as the reducing agent.

20 Claims, 1 Drawing Figure

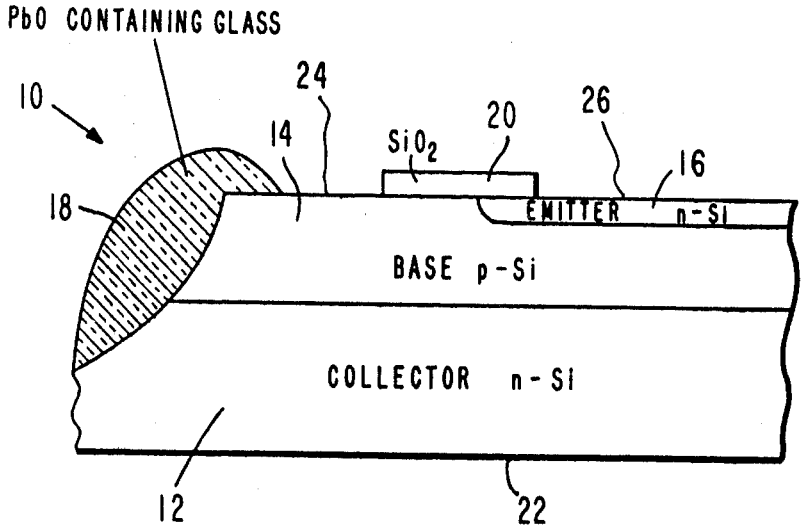
PbO CONTAINING GLASS
10
24
14
SiO2
20
26
16
18
EMITTER
n-Si
BASE p-Si
COLLECTOR n-Si
12
22

METHOD OF APPLYING THIN METAL DEPOSITS TO A SUBSTRATE

This invention relates to a process for applying thin metal deposits to a substrate. More particularly, this invention relates to a process for applying metal sensitizing deposits to semiconductor devices for subsequent electroless plating.

BACKGROUND OF THE INVENTION

In the manufacture of semiconductor devices, particularly devices such as thyristors, n-p-n or p-n-p transistors, silicon rectifiers, diodes, silicon solar cells, and the like, metal contacts must be applied to the device to apply or carry away electric current during operation of the device. The substrate layer, which may be overcoated or passivated with layers such as silicon oxide, silicon nitride, or metal oxide-containing glasses, is exposed using standard photolithographic techniques with a suitable resist in the areas to be metallized. The exposed substrate surface is cleaned and the metal is electrolessly plated onto these exposed portions of the substrate surface. Since substrate materials, such as silicon, which may have been variously p- or n- doped during manufacture of the particular device, do not accept electroless plating in a uniform manner, the substrate surface is first sensitized with a noble or other metal. This sensitization layer is very thin and discontinuous and usually forms islands of metal on the surface to be plated. These islands act as seeds or nucleation sites for subsequent electroless plating. After the electroless plating, the metallized substrate is sintered at elevated temperatures to react the metal layer with the substrate to form a strongly adherent film of metal silicide. The plating and sintering steps may be repeated if desired.

In the conventional process for making semiconductor contacts the sensitizing metal solution contains a metal salt, such as palladium chloride or gold chloride and HF in an acidic diluent such as acetic acid. The exchange reaction which takes place in this process at the silicon surface is represented by the following:

$$Pd^{+2}+2e \rightarrow Pd^{\circ}$$

$$Si^{\circ}-4e \rightarrow Si^{+4}$$

Thus the metal, palladium, is deposited on the silicon and the silicon is removed by forming a water soluble silicon fluoride. The concentrations of the HF and palladium chloride in the solution are varied depending on the doping levels of the silicon surface to be sensitized. The HF is required to maintain the silicon surface in an active state, free of silicon oxide deposits, and to remove the ionized silicon as a water soluble silicon fluoride compound which is formed during the exchange reaction.

At the optimum HF concentrations, the solubility of passivating layers of silicon dioxide and metal oxide-containing glass in the sensitizing solution is considerable. This solubility is undesirable for several reasons: the passivating layers can be damaged by the HF; and metal oxides, such as lead oxide, which may be present in the glass passivating layer, are dissolved by the HF and deposit on the exposed silicon surface as ionic or metallic lead, poisoning them to subsequent electroless plating.

Thus, a method of applying sensitizing metal deposits which eliminates the use of HP would be highly desirable.

SUMMARY OF THE INVENTION

We have found that the presence of HF and its disadvantages can be eliminated and metal deposits of improved uniformity can be obtained by immersing a silicon substrate, having exposed areas of silicon, in a basic, aqueous solution containing a metal salt of the metal to be deposited, particularly a nickel, cobalt or platinum salt, and subsequently reducing the metal ion of the metal salt to the elemental metal by use of the exposed silicon as the reducing agent. Further, if desired, by siliciding the applied metal deposits, a uniform silicide, e.g., nickel silicide, is formed on the surface of the silicon substrate. The thus obtained deposits or silicide accept subsequent electroless plating uniformly and reproducibly, independently of the doping levels of the silicon substrate or variations in crystal orientation of the silicon substrate.

BRIEF DESCRIPTION OF THE DRAWING

The single FIGURE of the drawing represents a transistor which is to be metallized according to the invention.

DETAILED DESCRIPTION OF THE INVENTION

In one embodiment of the invention a silicon n-p-n transistor, as shown in the FIGURE of the drawing, is metallized according to the invention. The transistor 10 comprises a collector n-doped layer 12, a base p-doped layer 14 on collector layer 12 and an emitter n-doped layer 16 on base layer 14. A lead oxide glass passivating layer 18 covers one end of the device and a patterned silicon dioxide passivating layer 20 overlies portions of base layer 14 and emitter layer 16. Portion 24 of the base layer 14 and portion 26 of the emitter layer 16 are exposed for metallization, as is the rear surface 22 of collector layer 12 of the device 10.

To manufacture such a device according to the invention, the transistor 10 is cleaned by first immersing in a concentrated nitric acid solution at 100° C., and next rinsing with deionized water. The cleaned transistor is then immersed in a presensitization, aqueous, basic solution bath. Thereafter, the transistor is immersed in a metal sensitization bath similar to the presensitization bath and containing a water soluble salt of the metal to be deposited. In the first, or presensitization bath, the exposed silicon is dissolved and hydrogen is evolved, while in the second, or metal sensitization bath, the exposed silicon is dissolved and metal ion is reduced along with hydrogen being evolved.

Solutions such as the halides, sulfates, and the like of metals including nickel, cobalt, platinum, and the like can be employed. However, the invention will be further described, illustrated, and discussed with reference to nickel chloride. The solution, in addition to containing nickel chloride and water, may also include sodium citrate and sodium hydroxide to control the pH and maintain the solution in a basic to strongly basic condition. The sodium citrate also prevents precipitation of nickel as nickel hydroxide. Additionally, an amine, such as ethanolamine, is added to the solution to complex the silicon ion which is formed during the reaction at the exposed silicon surface. When the metal salt (nickel chloride) solution is brought into contact with the exposed silicon portions of the device, a reaction is initiated in which the silicon reduces the metal ion of the metal salt to elemental metal (nickel), and the silicon ion formed is complexed by the amine of the solution.

Preferably, the nickel chloride sensitization solution will contain from about 0.02 to 0.09 weight percent nickel chloride; from about 1.9 to 9.4 weight percent ethanolamine; from about 23.6 to 33.0 weight percent sodium citrate; and from about 0.9 to 2.8 weight percent sodium hydroxide. In a preferred embodiment, the sensitization solution included 350 milliliters of water, 150 grams of sodium citrate, 10 grams of sodium hydroxide, 20 milliliters of ethanolamine, and 0.2 gram of nickel chloride. The sensitization solution or bath is preferably used at temperatures ranging between about 60° C. and 100° C., and its pH is maintained at a value above 12.

The exchange reaction which takes place at the surface of the exposed silicon can be illustrated as follows:

$$Ni^{+2} + 2e \rightarrow Ni^{\circ}$$

$$Si^{\circ} - 4e \rightarrow Si^{+4}$$

The applied nickel deposit may then be heated at a temperature from about 350° C.–600° C. to form nickel silicide by reaction of the nickel and the silicon substrate in a non-oxidizing atmosphere, e.g., in a hydrogen-containing gas or in an inert atmosphere of argon, nitrogen, and the like. The reaction is not strongly dependent on the doping level of the silicon substrate and also does not take place between nickel and silicon dioxide or glasses at these temperatures. At this point, if desired, excess nickel can be removed with a solution of nitric acid. While the above sintering or siliciding step is desirable, it is not required prior to further electroless plating. If the nickel deposit was silicided, the surface is washed in a sodium hydroxide solution prior to electroless plating.

The previously applied nickel deposit can now be readily, reliably and reproducibly electrolessly plated in known manner, such as with a Brenner solution. Electroless plating baths to produce layers of nickel, copper, cobalt, and the like are well known. Electroless nickel baths containing hypophosphites are particularly suitable when making silicon device contacts. After the electroless plating, the silicon device is again rinsed with deionized water and is now silicided by heating at a temperature above about 400° C. in a hydrogen atmosphere. A final concentrated nitric acid rinse removes any nickel phosphide and unsilicided nickel. Thus, the nickel on the surfaces which did not form nickel silicide is removed at this point. The electroless plating and siliciding steps can be repeated to build up a layer of the desired thickness and uniformity.

Although the silicon substrate, as discussed above, has been referred to as single crystal silicon, the substrate can be other forms of silicon, as for example polycrystalline silicon, oxygen-doped polysilicon, or amorphous silicon.

The above process has several advantages over the prior art process: the metal plating deposition rate is independent of the silicon doping level, thereby improving uniformity of the thickness of the metal layer; the metal plating deposition rate is determined solely by the etch rate of silicon, thus the growth rate of nickel cannot exceed the silicon dissolution rate; the damage to passivating layers of glass or silicon oxide is greatly reduced because of the elimination of HF-containing sensitizing solutions; the danger of lead poisoning of the metal plating solution is also greatly reduced, thereby diminishing the need for protective overcoating of lead oxide-containing glasses, such as with silicon dioxide; and the use of noble metals, such as platinum and/or gold, is eliminated.

The electroless nickel plating bath commericially employed contains phosphorus as hypophosphite. Phosphorus is also a well known n-type dopant. Thus, the nickel layer also contains some phosphorus. When the phosphorus-containing nickel layer is applied to an n-doped silicon layer, no problem arises. But, if it is to be applied to a p-doped silicon layer, the phosphorus in the nickel can migrate into the silicon layer, particularly at higher temperatures, forming a rectifying junction and degrading the device. By being able to limit the temperature below about 500° C. during the sintering step, this problem is minimized by the present process.

On the other hand, if one wishes to enhance n-doping in a silicon layer, one can increase the siliciding temperature to 600° C. or higher, thereby enhancing the migration of additional n-type dopant into the silicon layer. This reduces the contact resistance of the metallurgical silicide-silicon junction, since there is phosphorus present both in the nickel layer and in the silicon layer. Thus, depending on the substrate doping, sintering temperatures can be chosen so as to enhance rather than to degrade the device.

In order to illustrate the invention with greater particularity the following specific example is included. This example is intended to illustrate only and is not intended to limit the invention in any way.

EXAMPLE

A passivated and patterned n-p-n silicon transistor wafer, as in accord with the FIGURE of the drawing, was cleaned in concentrated nitric acid at 100° C. for 5 minutes and rinsed in deionized water. The wafer was then immersed in a presensitization basic solution, containing water, about 28 weight percent sodium citrate, about 2 weight percent sodium hydroxide, and about 4 weight percent ethanolamine at 80° C. for 15 seconds with agitation. Next, a thin deposit of nickel was applied to the exposed areas of silicon by immersing the wafer for a period of approximately 30 seconds with vigorous agitation in a nickel chloride solution, maintained at approximately 80° C. The nickel chloride solution contained 350 milliliter of water, 150 grams (28.3 weight percent) of sodium citrate, 10 grams (1.9 weight percent) of sodium hydroxide, 20 milliliters (3.8 weight percent) of ethanolamine, and 0.2 gram (0.04 weight percent) of nickel chloride.

The nickel plated wafer was then immersed in a standard electroless nickel plating bath at 75° C. for 1 minute. The nickel bath contained 30 grams of nickel chloride, 10 grams of sodium hypophosphite, 100 grams of sodium citrate, and 50 grams of ammonium chloride per liter and had a pH of 9. A layer of nickel about 1,000 angstroms thick (plus or minus 250 angstroms) was applied over the initial nickel nucleation coating. After rinsing in deionized water and drying, the wafer was sintered at 450° C. for 10 minutes in forming gas.

The wafer was thereafter immersed in concentrated nitric acid at 100° C. for 1 minute to remove unreacted nickel and rinsed with water. The plating, sintering, and rinsing steps were repeated, except that the second time plating was continued for 3 minutes. A third plating and rinsing followed. Thereafter, the wafer was found to be selectively metallized on its front surface in those previously exposed areas of silicon, completely metallized on its rear surface, and now ready for soldering.

We claim:

1. A method of applying thin metal sensitizing deposits from aqueous solution to the exposed silicon areas of a silicon substrate having exposed areas of silicon and silicon oxide, which comprises, immersing the silicon substrate in a basic, aqueous solution containing a metal salt of the metal to be deposited, not containing a reducing agent and reducing the metal ion by use of the exposed silicon as the reducing agent to the elemental metal.

2. The method according to claim 1 wherein said aqueous solution contains an amine.

3. The method according to claim 2 wherein the metal salt is selected from the group consisting of salts of nickel, cobalt, and platinum.

4. The method according to claim 3 wherein the metal salt is nickel chloride and the amine is ethanolamine.

5. The method according to claim 3 wherein a metal layer is deposited onto said metal sensitizing deposits by electroless plating.

6. The method according to claim 5 wherein the plated metal is nickel.

7. The method according to claim 3 wherein the applied metal sensitizing deposits are reacted with the silicon to form metal silicide layers by heating to a temperature of between 350° C.–600° C.

8. The method according to claim 7 wherein a metal layer is deposited onto said metal silicide layers by electroless plating.

9. The method according to claim 8 wherein the plated metal layer is reacted with the silicon at a temperature of at least about 400° C.

10. The method according to claim 8 wherein the plated metal is nickel.

11. A method of providing metal contacts to the exposed silicon areas of a silicon semiconductor device having portions of the silicon to be metallized exposed, which comprises, immersing the silicon device in a basic, aqueous metal salt-containing solution, not containing a reducing agent, reducing the metal ion of the solution to the elemental metal by use of the exposed silicon as the reducing agent, and electrolessly plating a metal layer onto said deposited metal.

12. The method according to claim 11 wherein said aqueous solution includes an amine.

13. The method according to claim 12 wherein said metal salt is nickel chloride.

14. The method according to claim 11 wherein said electrolessly plated metal layer is silicided by heating to a temperature of at least about 400° C. in a non-oxidizing atmosphere.

15. The method according to claim 11 wherein said electrolessly plated metal layer is nickel.

16. The method according to claim 11 wherein said originally deposited elemental metal is silicided by heating in a non-oxidizing atmosphere to a temperature of from about 350° C.–600° C. prior to the electroless plating.

17. The method according to claim 16 wherein the electrolessly plated metal is phosphorus-containing nickel.

18. The method according to claim 17 wherein the silicon device is a p-n-p transistor.

19. The method according to claim 17 wherein the silicon device is an n-p-n transistor.

20. The method according to claim 19 wherein said electrolessly plated metal layer is silicided by heating to a temperature of at least about 600° C. in a non-oxidizing atmosphere.

* * * * *